US005721529A

United States Patent [19]

Vane et al.

[11] Patent Number: 5,721,529

[45] Date of Patent: *Feb. 24, 1998

[54] INDIVIDUAL SMOKE DETECTOR WITH STORED RANGE OF ACCEPTABLE SENSITIVITY

[75] Inventors: Burton Warner Vane, Fairport; David Bush Lederer, Sodus Point, both of N.Y.

[73] Assignee: Detection Systems, Inc., Fairport, N.Y.

[ * ] Notice: The term of this patent shall not extend beyond the expiration date of Pat. No. 5,552,765.

[21] Appl. No.: 691,153

[22] Filed: Aug. 1, 1996

Related U.S. Application Data

[63] Continuation of Ser. No. 89,539, Jul. 12, 1993, Pat. No. 5,552,765.

[51] Int. Cl.[6] ..... G08B 29/00

[52] U.S. Cl. ..... 340/515; 340/514; 340/511; 340/628

[58] Field of Search ..... 340/515, 514, 340/511, 628, 629, 630, 588, 589

[56] References Cited

U.S. PATENT DOCUMENTS 4,546,344 10/1985 Guscott et al. ..... 340/511
4,757,303 7/1988 Scheidweiler ..... 340/511
4,785,283 11/1988 Yuchi ..... 340/511
5,552,765 9/1996 Vane et al. ..... 340/515

*Primary Examiner*—Donnie L. Crosland
*Attorney, Agent, or Firm*—J. Addison Mathews

[57] ABSTRACT

A smoke detector is provided with testing apparatus for determining if its sensitivity is within a predetermined acceptable range. The testing apparatus stores in the detector a range representing acceptable sensitivities. When a test is initiated the resulting test output is compared to the sensitivity range, or its representation, and a warning signal is provided when the output is not acceptable. According to one feature, the stored representations of the acceptable range include a maximum acceptable value and a minimum acceptable value, and the warning signal indicates when the output is above the maximum or below the minimum. According to other features, the output signal is periodic at one frequency when above the maximum and at another frequency when below the minimum. The test is initiated by a magnetic reed switch and the results are immediately apparent. Each smoke detector is calibrated on an individual basis that accounts for its particular electrical response, and the calibration information is retained in the detector wherever it goes after installation.

5 Claims, 5 Drawing Sheets

FIG. 1
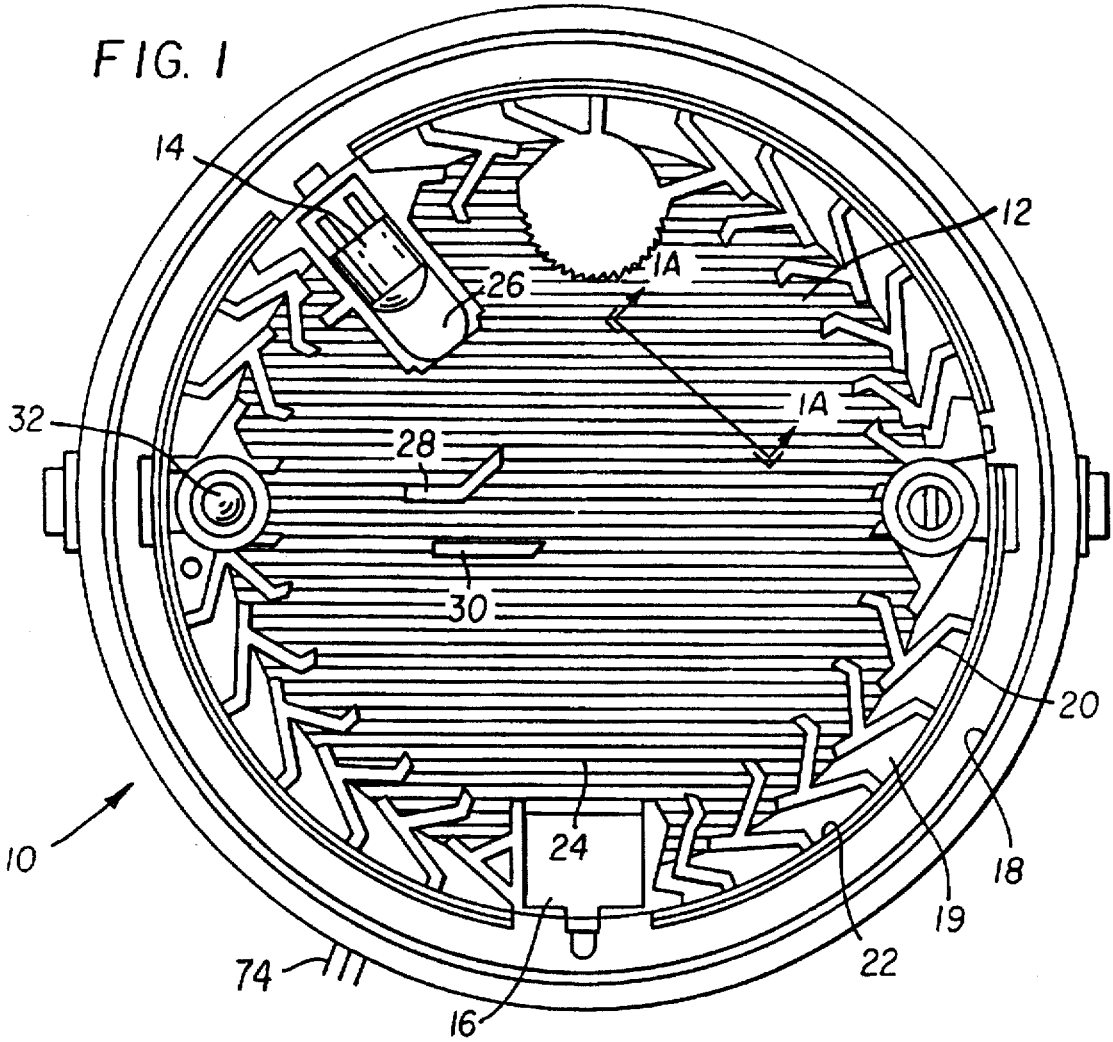
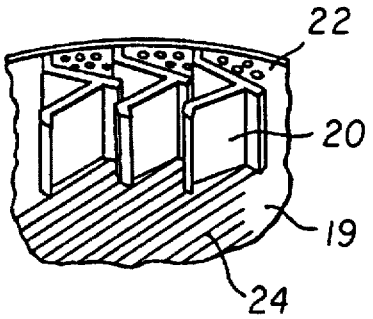
FIG. 1A

INDIVIDUAL SMOKE DETECTOR WITH STORED RANGE OF ACCEPTABLE SENSITIVITY

CROSS-REFERENCE TO RELATED APPLICATIONS

This application is a continuation of our commonly assigned, patent application Ser. No. 08/089,539, file Jul. 12, 1993 now U.S. Pat. No. 5,552,765.

Reference is made to commonly assigned, U.S. patent application Ser. No. 08/089,540, now U.S. Pat. No. 5,543,777 entitled SMOKE DETECTOR CALIBRATION AND MONITORING, filed on Jul. 12, 1993 in the names of Burton W. Vane and David B. Lederer. The disclosure of this cross-referenced application hereby is incorporated by reference into the present application.

BACKGROUND OF THE INVENTION

1. Field of Invention

The invention relates to smoke detection, and more specifically to a method and apparatus for calibrating a smoke detector prior to installation and for testing the operation of the detector after installation and use.

2. Description of the Prior Art

Prior art smoke detectors typically include a dark chamber through which airborne particles of smoke are free to circulate. A source of light, such as an infrared emitter, directs illumination along a defined path extending into the chamber. A photoelectric sensor is positioned out of the path of direct illumination, but is aimed to view the chamber and illumination scattered or reflected from the path by circulating particles including smoke. When the sensor detects a level of illumination above a predetermined threshold, it issues an alarm signal.

Smoke detectors may be calibrated prior to installation and monitored for proper performance throughout their useful life. During calibration, an atmosphere representing a predetermined level of obscuration, such as three percent per foot, may be injected into the chamber and the smoke detector adjusted to alarm at the resulting signal level. The calibration level is chosen to represent the conditions that would exist when a fire is in its early stages of development.

Monitoring the detector after installation is somewhat more difficult. Frequently the detector must be removed from its installed location so it can be tested in a manor similar to that used prior to installation. Still, a satisfactory solution is not so simple. Detectors accumulate dust and other reflecting material in their chambers over time. The dust reduces the amount of obscuration required to activate an alarm, increasing the sensitivity of the detector and its tendency toward false alarms. Other problems may occur with opposite effects. A bug or foreign matter may partially block the source of illumination, decreasing the sensitivity of the detector and its ability for early warning. In either case the detector may still have an extended period of useful life, but its sensitivity and remaining life are difficult to determine with calibration samples.

Statistical sampling has been employed to estimate changes in detector performance. Many variables are involved, however, because the characteristics of the individual detector are seldom retained after installation. Each detector is different from other detectors in the same family, and, of course, the conditions of installation vary greatly. As noted above, some effects tend to increase sensitivity while other effects may reduce sensitivity, and, although not entirely random, historical changes are very difficult to predict.

SUMMARY OF THE INVENTION

The present invention is directed to overcoming one or more of the problems set forth above. Briefly summarized, according to one aspect of the invention, a smoke detector is provided with apparatus that is convenient and easy to use for testing the sensitivity of the detector, after installation and use, to determine if it is within a predetermined acceptable range. The testing apparatus stores in the detector a range of electrically stored values representing the acceptable sensitivities. When a test is initiated after installation, the resulting output of the test is compared to the sensitivity range, or its representation, and a warning signal is provided when the output is not acceptable.

According to one feature of the invention, the stored representations of the acceptable range include a maximum acceptable value and a minimum acceptable value, and the warning signal indicates when the output is above the maximum and when the output is below the minimum. According to other features of the invention, the output signal is periodic at one frequency when above the maximum and at another frequency when below the minimum. The test is initiated by a magnetic reed switch and the results are immediately apparent.

Each smoke detector is calibrated with an acceptable range on an individual basis that accounts for its individual electrical response, and the calibration information is retained in the detector wherever it goes after installation. The test is conducted electronically without the need for calibrated obscuration samples.

The features and advantages mentioned above, and that will become apparent from the following description, are available in a detector that is suitable for use in existing two and four wire systems, and does not require the complexity of multiplexing, where each detector has a unique identification recognized by a central control.

The invention will be more clearly understood and appreciated from the following detailed description of the preferred embodiment and appended claims, and by reference to the accompanying drawings.

BRIEF DESCRIPTION OF THE DRAWINGS

FIG. 1 is a top plan view of a smoke detector with the top removed, including an infrared emitter and optical sensor on opposite sides of a dark chamber.

FIG. 1A is a partial perspective view taken from section 1A—1A in FIG. 1, showing more detail of the peripheral structure of the dark chamber.

DESCRIPTION OF THE PREFERRED EMBODIMENTS

Figure 2:
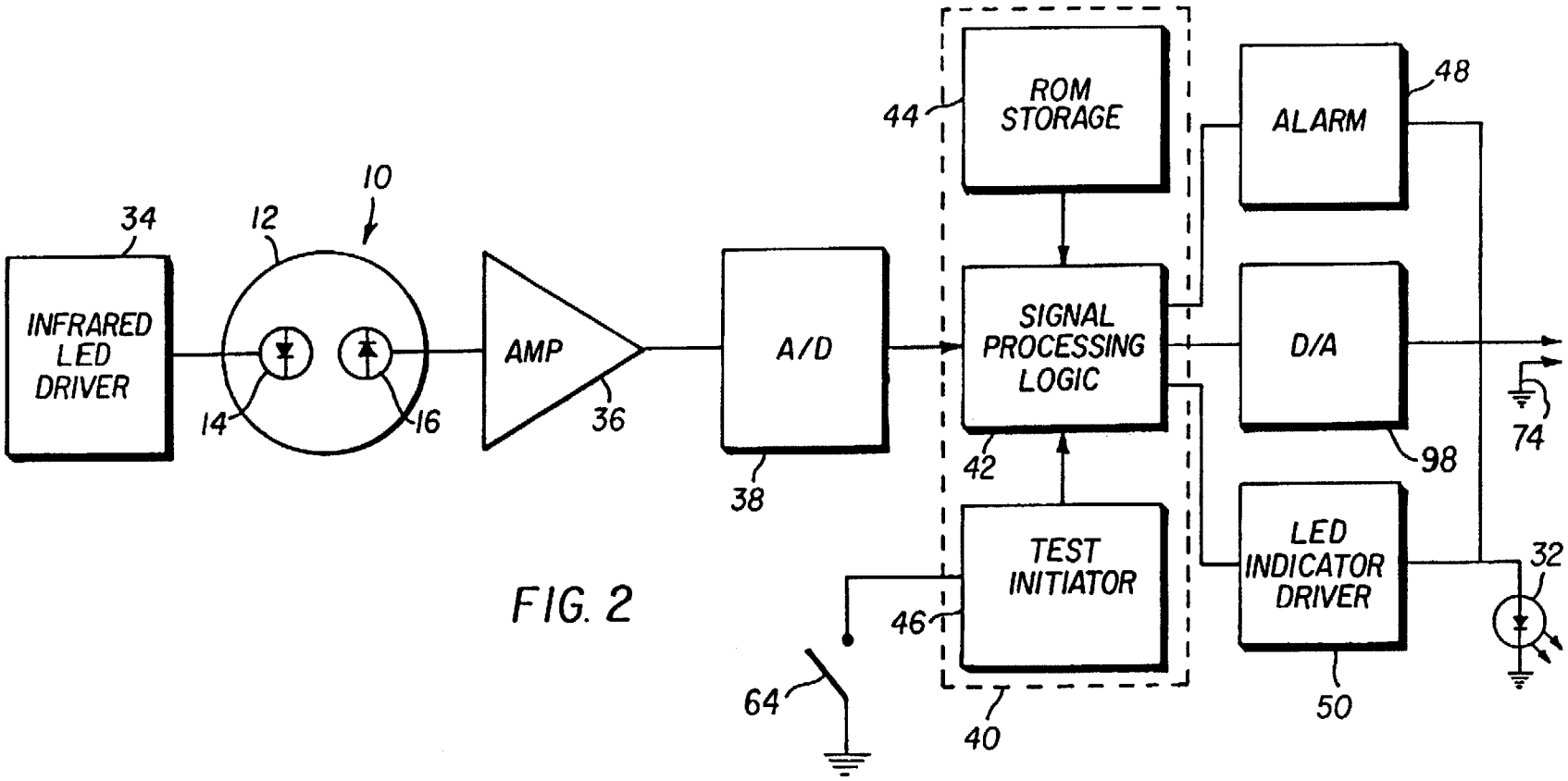
FIG. 2 is a block diagram depicting elements and circuits included in the detector of FIGS. 1 and 1A for storing and using calibration information in accordance with the invention.

Referring now to FIGS. 1 and 1A, a preferred embodiment of a smoke detector 10 is depicted in accordance with the present invention, including a dark chamber 12 containing an infrared emitter 14 and an optical sensor 16 in the form of a photo detector sensitive to the infrared wavelengths of the emitter 14.

The chamber 12 is defined by a hollow base 18 and cap (not shown) including floor 19 and cover sections separated by a peripheral wall 20 of overlapping bent fingers. The fingers define a tortuous path for blocking external ambient light from the chamber with minimal interference to the circulation of air and smoke. A fine-mesh screen 22 surrounds the periphery of the chamber around the fingers and is sandwiched between the floor and cover to block insects and large dust particles from the chamber. The mesh size is chosen to provide minimal resistance to the passage of smoke particles, particularly those particles of a size and type generated by a fire during its early stages of development. The interior surfaces of the chamber are black and shaped to reflect any incident light away from the optical sensor 16. The floor and cover include reticulated surfaces 24, for example, to reduce reflections within the chamber.

The emitter 14 and optical sensor 16 are positioned on opposite sides of the chamber, at an angle of approximately 140 degrees, to optimize the response of the detector to a variety of typical smoke particles. The emitter is a light emitting diode (LED), operating in the infrared, which directs a beam or spot of light across the chamber. The spot is confined by apertures 26 defined by mating surfaces of the floor and cover. Upstanding baffles 28 and 30 provide a dual septum that blocks the optical sensor from directly viewing the emitter and further confines the beam to its desired path. The optical sensor 16 includes a photo diode mounted out of the path of direct illumination, but aimed to view the chamber and any illumination scattered or reflected from the path by circulating particles, such as smoke. Although not apparent from the drawings, the photo diode actually is below the chamber and light is reflected to it by a prism and focused on it by a lens.

Under clean-ambient conditions, the background scatter, or level of infrared radiation reflected by the chamber into the sensing element 16, is low. When airborne smoke enters the chamber, the amount of radiation reflected out of the illumination path and into the optical sensor increases. The electrical output of the optical sensor is proportional to the reflected radiation entering the sensor, and when the resulting signal exceeds a predetermined threshold, an alarm is activated. The alarm may include visual or audible warnings issued from the alarm itself or from external generators connected to the alarm typically through a control panel. One such warning device illustrated in FIG. 1 is a light emitting diode (LED) 32, operating in visible wavelengths. This same LED also serves a number of other functions that will be described hereinafter.

Referring now to FIG. 2, the emitter 14 is pulsed on for one hundred and fifty microseconds (150 μsec.) every seven seconds (7 sec.) by a temperature compensated current driver 34. The output of the optical sensor 16 is amplified by an operational amplifier 36, configured as a DC coupled current amplifier. After amplification, the signal is converted from an analog to a digital representation of the sensor output by a sample and hold circuit and analog-to-digital (A/D) converter 38. Of course other digital or analog approaches might be employed.

Operation of the smoke detector is controlled by a micro controller 40 including signal processing logic 42, write once and Read Only Memory (ROM) 44 and test initiator 46. It is the micro controller that controls the timing of the emitter pulses. The micro controller also coordinates sampling of the sensor output signal in accordance with a timed sequence properly coordinated with the emitter.

Prior to installation of the smoke detector, preferably during its manufacture, each detector is calibrated on an individual basis and the resulting calibration factors are stored by the micro controller 40 in ROM 44 for later use.

A first calibration factor represents an alarm condition, and is determined by circulating through chamber 12, a gaseous or aerosol calibration medium. The circulation medium represents the lowest percent obscuration per foot that should cause the detector to issue an alarm. When the medium enters the chamber, it reflects infrared energy out of the path of radiation from emitter 14, where it is viewed by optical sensor 16. The output signal that results from the test is measured and stored, preferably in digital form, for use by the detector during its operation.

A second calibration factor represents a corresponding output signal under clean-ambient conditions. This signal is measured without obscuration and is stored by the micro controller 40 in ROM 44 for later use in monitoring the sensitivity of the detector throughout its useful life. In the preferred embodiment, it is not actually the clean-ambient signal that is retained in storage, but rather a digital representation of the difference between the alarm and clean-ambient signals. In accordance with other embodiments, both the alarm and clean-ambient output signals might be stored, or either one of the output signals and the difference between them. Still other embodiments might employ look-up tables, or the like, that would assign coordinate values representing the desired calibration factor.

Still other calibration factors represent the range of acceptable sensitivities, from a maximum value to a minimum value, that will be used for test purposes to be described more fully hereinafter.

After installation of the detector, and during its operation, the detector repeatedly samples the output from optical sensor 16 and compares the output to the stored value representing an alarm condition. If the sampled value exceeds the alarm threshold, the micro controller activates alarm 48 and energizes visible LED 32 either through the alarm, as shown, or through the micro controller and LED driver 50. In the preferred embodiment, the alarm is activated only after the threshold is exceeded by three successive samples. This reduces the possibility of an alarm caused by transient conditions such as cigarette smoke or airborne dust.

Figure 3:
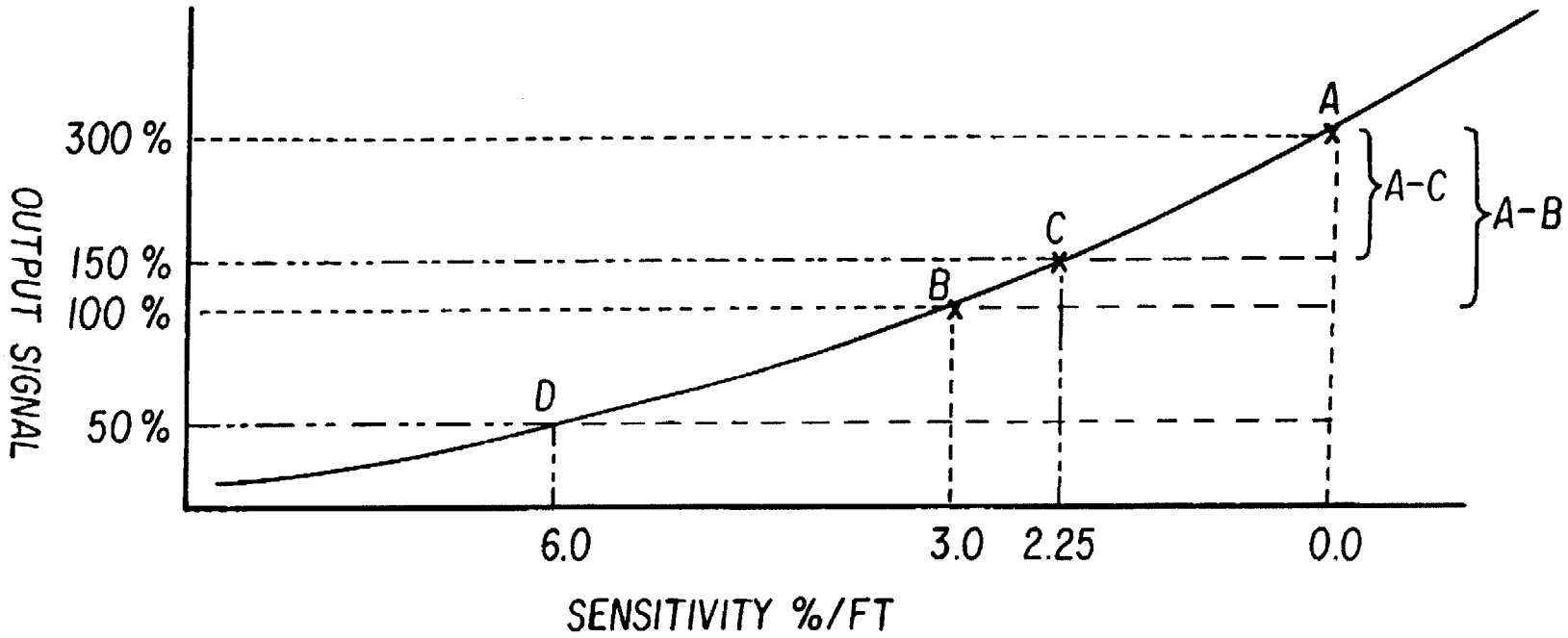
FIG. 3 is a graph depicting the calibration and acceptable ranges of sensitivity determined prior to installation and corresponding values sampled during monitoring after installation.

Referring now to FIG. 3, Point A represents the alarm condition and Point B represents the clean-ambient condition. Immediately following calibration of the smoke detector, its sensitivity, measured as visible obscuration in percent per foot, is represented by the difference between points A and B, and is equal to the amount of obscuration in the gaseous medium used to calibrate the alarm threshold. The difference between Points A and B is three percent per foot obscuration along the X axis, and is represented, for example, by an output signal along the Y axis of 200 millivolts (shown as a percent in FIG. 3).

After installation, dust and other reflective material may settle in the chamber, accumulating over time. This increases the background scatter and reduces the amount of smoke required to reach the alarm threshold, thereby increasing the sensitivity of the detector and its propensity to false alarm. The detector also may become less sensitive than the calibrated sensitivity due to blockage of the emitter or other malfunction. In this case, more than the calibrated amount of smoke is required to reach the alarm threshold. Point C on FIG. 3 represents changes in the detector that increase its sensitivity. Two and a quarter percent per foot (2.25%/Ft.) obscuration will cause the detector to alarm from Point C. Point D, on the other hand, represents changes that decrease the detector's sensitivity. Six percent per foot (6%/Ft.) obscuration is required to reach the alarm condition from Point D.

Figure 4:
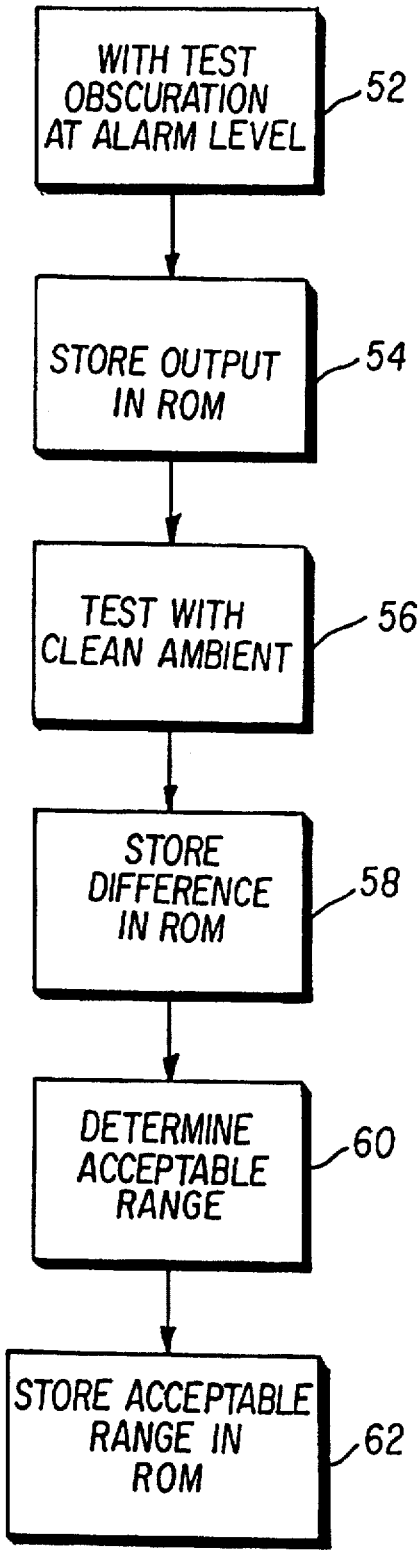
FIG. 4 is a flow diagram depicting the steps for establishing the calibration ranges prior to installation.

The information or calibration factors obtained during the initial calibration of each detector is used to determine and store a range of acceptable sensitivities for subsequent testing of the detector after its installation. Referring to FIG. 4, each detector is tested prior to installation, box 52, with a calibration sample representing an alarm condition, and the resulting output signal is stored in ROM, box 54, for later use. The detector is tested under clean-ambient conditions at approximately the same time, box 56, and the resulting output again is stored in ROM for later use, box 58. An acceptable range of sensitivities is determined, box 60, and the range, or its limits, are stored in ROM, box 62, for testing of the detector after its installation. Continuing now with the example started above, Point C on FIG. 3 might represent the upper end of the acceptable range at 2.25%/ft. sensitivity and 150 millivolts (percent on FIG. 3), while Point D might represent the lower limit at 6%/ft. sensitivity and 50 millivolts (percent in FIG. 3). Point C was selected based on one quarter of the Y axis distance between Points A and B, and Point D was selected based on one half of the Y axis distance between Point B and the x axis. Although other points might be selected, the selection is based on the parameters of each individual detector prior to its installation, preferably during its manufacture, and is stored to remain with the detector throughout its useful life.

Other sensitivity targets and ranges are preferred in some instances for compliance with requirements of the National Fire Protection Association (NFPA). The approach is substantially the same, but the values preferred would be an initial sensitivity of three and a half percent per foot (3.5%/ft.) sensitivity and a range of plus or minus point nine five percent per foot (0.95%/ft.). The acceptable range, then, would be from two and one quarter percent per foot (2.25%/ft) at one end to four point one five percent per foot at the other end (4.15%/ft.).

Figure 5:
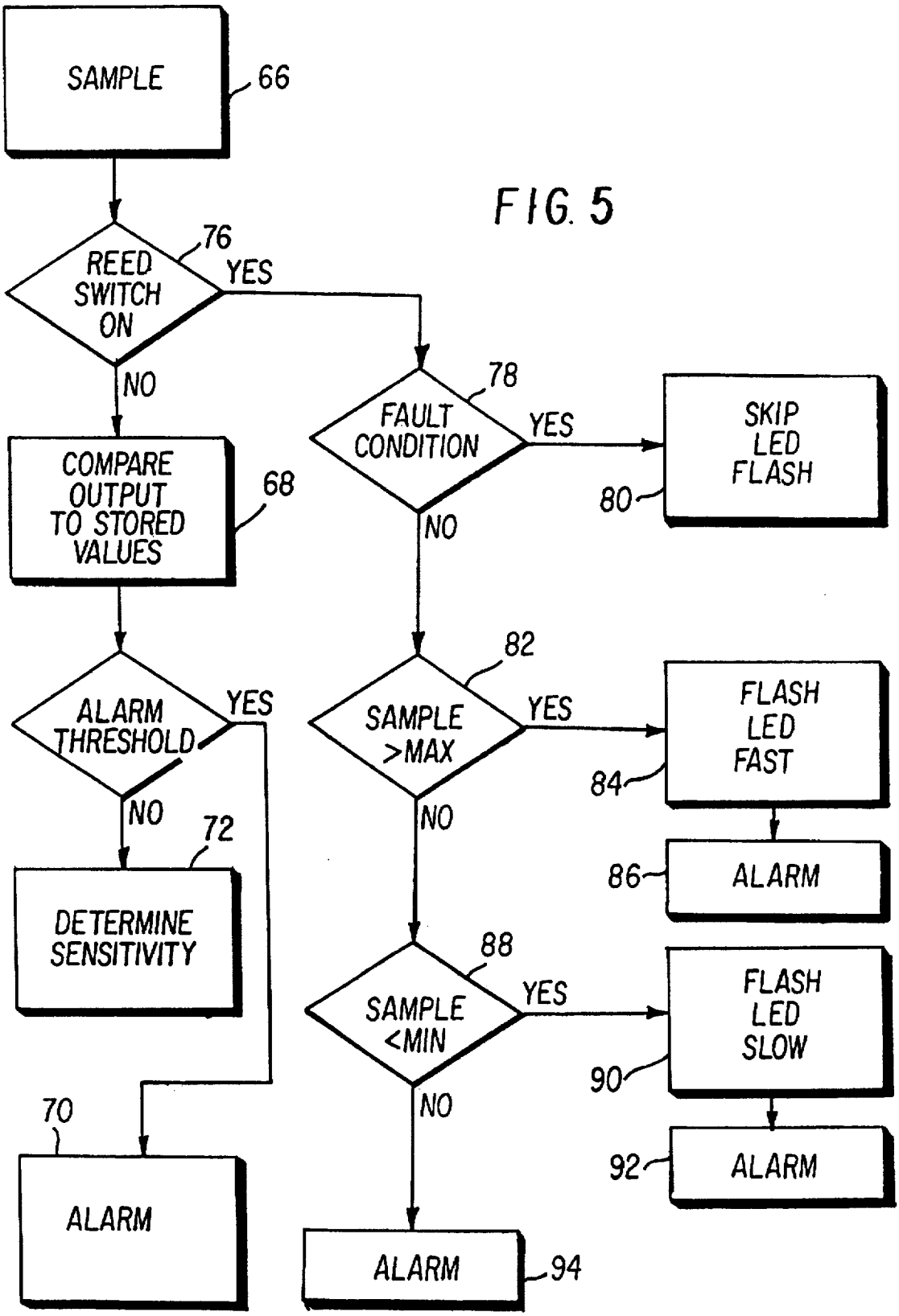
FIG. 5 is a flow diagram depicting the steps for testing the detector after installation.

FIG. 5 represents steps for testing the detector during its use after installation, and is described here in conjunction with FIG. 2. Reed switch 64, FIG. 2, is magnetically actuated to initiate a test sequence. Assuming first that the test sequence is not actuated, and the detector is in its normal mode of operation, ambient conditions are sampled, box 66, and compared to the alarm threshold determined during calibration, box 68. If the monitored value exceeds the alarm threshold, the alarm is activated, box 70, as described above. If below the alarm threshold, the remaining sensitivity is determined, box 72, and made available at contacts 74 (FIG. 2).

The sensitivity determination is based on the relationships depicted in FIG. 3, and the realization, after extensive testing, that the sensitivity of the detector at any particular time can be approximated by a straight line relationship compared to the change in output signal under ambient conditions. Thus the sensitivity represented by point C can be determined from the ratio of the difference A–C over the difference A–B. An output signal based on this ratio is made available by micro controller 40 at contacts 74. This feature is described more fully in our above-referenced patent application filed on even date herewith.

When magnetic reed switch 64 is activated, to initiate a test sequence, decision box 76, the micro controller first tests for fault conditions, box 78. A fault condition has no visible output, box 80, which indicates a bad detector that must be replaced. If there is no fault condition, the test output is compared to the acceptable range. In the preferred embodiment the test output is compared first to a maximum at one end of the range, decision box 82. If the output exceeds the maximum, the LED 32 is flashed at a rapid rate such as twice a second, box 84, and the alarm is activated, box 86. If the output does not exceed the maximum, it is compared to the minimum at the other end of the range, decision box 88. If below the minimum, the LED 32 is flashed at a slow rate, such as once every two seconds, box 90, and the alarm is activated, box 92. If the output is within the acceptable range, the LED does not flash, but the alarm is activated to indicate a successful test, box 94.

In summary, the present invention provides a smoke detector including apparatus and a method for testing the detector after installation to make sure it is operating within an acceptable range of sensitivities. Representations or measures of acceptable sensitivities are determined on an individual detector basis and stored in the detector prior to its installation. During a test of the detector after installation, the detector compares its output signal to the predetermined measures of the acceptable range and issues a warning when the output is not within the range. In accordance with the preferred embodiment, the smoke detector compares the test output to maximum and minimum acceptable values and indicates when the output is above the maximum value or below the minimum value. The warning that the detector is outside the acceptable range preferably is a light emitting diode that flashes at one periodic frequency when above said maximum value and another frequency when below said minimum value.

The invention provides a simplified test of a detector's sensitivity within a desired range. Removal of the detector from its installed position is not required, nor is testing with an gaseous sample. According to one feature of the invention, sensitivity is based on the electrical characteristics of each individual detector, not a statistical sampling. According to another feature, the test easily is initiated by an external magnetic probe that removes the detector from its operational mode for only a very short period. All of the above-mentioned features and advantages are available in a detector that can be installed in existing two and four-wire installations. Multiplexed central control is not required.

While the invention has been described with particular reference to a preferred embodiment, it will be understood by those skilled in the art that various changes may be made and equivalents may be substituted for elements of the preferred embodiment without departing from the invention. It is intended that the claims shall cover all such modifications and applications as do not depart from the true spirit and scope of the invention.

What is claimed is:

1. An individual smoke detector including apparatus within the detector for testing the detector after installation for operation within an acceptable range of sensitivities, said apparatus comprising:

means for storing in the detector an alarm threshold and a limit of a predetermined sensitivity range;

means for providing an output characteristic of the level of atmospheric obscuration at the location of the detector;

means for comparing said output to said alarm threshold and said sensitivity limit, said means initiating an alarm signal when said output exceeds said alarm threshold and an out-of-range warning when said output exceeds said sensitivity limit.

2. A smoke detector according to claim 1, wherein said storing means includes representations of a maximum acceptable value for said sensitivity range and a minimum acceptable value for said sensitivity range, said comparing means compares said output to said maximum acceptable and minimum acceptable values, and said warning indicates when said output is above said maximum value and when said output is below said minimum value.

3. The invention of claim 2, wherein said warning is periodic at one frequency when above said maximum value and another frequency when below said minimum value.

4. The invention of claim 2, wherein said warning is a light emitting diode that flashes at one rate when above said maximum value and at another rate when below said minimum value.

5. A method of testing a smoke detector after installation for operation within an acceptable range of sensitivities, said method comprising:

storing in the detector an alarm threshold and limits of sensitivities within an acceptable range;

providing an output of the detector characteristic of the level of atmospheric obscuration at the location of the detector;

comparing said output to said limits and issuing an out of range signal when said output is not within said limits.

* * * * *